US006695530B2

(12) United States Patent
Crupi

(10) Patent No.: US 6,695,530 B2
(45) Date of Patent: Feb. 24, 2004

(54) MIXING APPARATUS AND METHOD FOR BLENDING MILLED ASPHALT WITH REJUVENATING FLUID

(76) Inventor: Francesco A. Crupi, 2845 Seabreeze Dr. South, Gulfport, FL (US) 33707

( * ) Notice: Subject to any disclaimer, the term of this patent is extended or adjusted under 35 U.S.C. 154(b) by 0 days.

(21) Appl. No.: 10/142,296

(22) Filed: May 9, 2002

(65) Prior Publication Data

US 2002/0172555 A1 Nov. 21, 2002

Related U.S. Application Data

(63) Continuation-in-part of application No. 09/592,398, filed on Jun. 13, 2000, now Pat. No. 6,416,249.

(51) Int. Cl.[7] ..... E01C 23/12

(52) U.S. Cl. ..... 404/91; 404/75; 404/77; 404/90; 404/92; 404/95

(58) Field of Search ..... 404/72, 75, 84.1, 404/90, 91, 92, 77, 79, 82, 95

(56) References Cited

U.S. PATENT DOCUMENTS

| | | | | |
|---|---|---|---|---|
| 3,841,177 A | | 10/1974 | Domenighetti | 404/84 |
| 3,843,274 A | | 10/1974 | Gutman et al. | 404/91 |
| 3,907,450 A | | 9/1975 | Cutler | 404/90 |
| 3,970,404 A | | 7/1976 | Benedetti | 404/77 |
| 4,011,023 A | | 3/1977 | Cutler | 404/91 |
| 4,124,325 A | * | 11/1978 | Cutler | 404/75 |
| 4,226,552 A | | 10/1980 | Moench | 404/92 |
| 4,300,853 A | | 11/1981 | Jones | 404/92 |
| 4,317,642 A | | 3/1982 | Wirtgen | 404/72 |
| 4,335,974 A | | 6/1982 | Wirtgen | 404/92 |
| 4,545,700 A | | 10/1985 | Yates | 404/75 |
| 4,682,909 A | | 7/1987 | Mihara | 404/90 |
| 4,780,022 A | | 10/1988 | Ohiba et al. | 404/90 |
| 4,784,518 A | | 11/1988 | Cutler | 404/79 |
| 4,793,730 A | | 12/1988 | Butch | 404/77 |
| 4,946,307 A | | 8/1990 | Jakob | 404/91 |

(List continued on next page.)

FOREIGN PATENT DOCUMENTS

DE 3731716 4/1988

OTHER PUBLICATIONS

H.I.P. "Get H.I.P." 1997.
Automated Recycling Systems Inc. "Log of Project" 1996.

*Primary Examiner*—Robert E. Pezzuto
*Assistant Examiner*—Alexandra K. Pechhold
(74) *Attorney, Agent, or Firm*—Butler, Snow, O'Mara, Stevens & Cannada PLLC

(57) ABSTRACT

A method and apparatus are provided for in situ rejuvenation of asphalt pavement. The apparatus and method provide for heating the underlying surface to form a preheated surface, passing a mill over the preheated surface and milling the preheated surface to loosen the preheated surface to a desired depth and discharging the milled material from opposite ends of the respective windrows of known breadth. Windrow height is measured as is rate of advance of the transport structure to determine a volume throughput. Rejuvenating fluid is added to each windrow at a dosage rate based on a desired weight percentage and the volume throughput. A mixer is passed over the windrows and receives the windrows through respective openings at either end thereof. The mixer also blends the rejuvenating fluid with the milled material and forms a blended mixture which is discharged from the mixer. The mixer may be a pug mill operated in an inverted arrangement utilizing the road surface as a bottom thereto.

6 Claims, 5 Drawing Sheets

U.S. PATENT DOCUMENTS

| | | | | | |
|---|---|---|---|---|---|
| 4,971,476 | A | | 11/1990 | Guillon | 404/91 |
| 4,974,993 | A | | 12/1990 | Crabbi | 404/79 |
| 5,000,615 | A | | 3/1991 | Murray | 404/75 |
| 5,002,426 | A | | 3/1991 | Brown et al. | 404/92 |
| 5,046,890 | A | | 9/1991 | Dickson | 404/90 |
| 5,080,524 | A | | 1/1992 | Lee | 404/90 |
| 5,219,450 | A | | 6/1993 | Thurk | 404/91 |
| 5,472,292 | A | | 12/1995 | Wiley | 404/79 |
| 5,741,085 | A | | 4/1998 | Wirtgen | 404/75 |
| 5,791,814 | A | | 8/1998 | Wiley | 404/91 |
| 5,848,755 | A | * | 12/1998 | Zickell et al. | 241/65 |
| 5,938,130 | A | * | 8/1999 | Zickell | 241/65 |
| 5,967,695 | A | | 10/1999 | Vural | 404/77 |
| 6,220,782 | B1 | | 4/2001 | Yates | 404/75 |
| 6,290,152 | B1 | * | 9/2001 | Zickell | 241/21 |

* cited by examiner

MIXING APPARATUS AND METHOD FOR BLENDING MILLED ASPHALT WITH REJUVENATING FLUID

This application is a continuation-in-part of U.S. patent application Ser. No. 09/592,398 filed Jun. 13, 2000 now U.S. Pat. No. 6,416,249.

FIELD OF THE INVENTION

This invention relates to apparatus for in situ rejuvenation of asphalt pavement. More particularly this invention relates to a method and apparatus for mixing milled asphalt pavement and rejuvenating fluid in such rejuvenation.

BACKGROUND OF THE INVENTION

Asphalt pavement consists essentially of an aggregate and sand mixture held together with a petroleum based binder, such as asphalt cement (ie. an "asphalt mix"). With continued exposure to sun, moisture, traffic, freezing and thawing, asphalt mix surfaces degrade. The degradation is principally in the binder, rather than the aggregate and sand mixture which makes up the bulk of the asphalt mix. Also, much of the degradation occurs within the top two or three inches of the surface.

Traditionally, worn asphalt pavement was not restored but was instead torn up and replaced with new asphalt mix. This is a costly approach and creates a problem as to what to do with the torn up pavement. Accordingly, techniques and apparatus have been developed for restoring or rejuvenating the top few inches of an asphalt paved surface.

A typical road resurfacing machine has a heater for heating and softening the asphalt pavement surface as it passes along the surface. Following the heater is a "rake" or "scarifier" which breaks up or "scarifies" the softened pavement. The scarified pavement is generally crushed or "milled", blended with rejuvenating fluid and optionally additional sand or aggregate and redeposited. The redeposited material is spread out and rolled to create a rejuvenated surface comparable in quality to the original surface before degradation.

In order to produce a rejuvenated surface of high quality, it is important to ensure that an appropriate amount of rejuvenating fluid is added. Generally, a core sample or several core samples are initially taken of the surface to be rejuvenated and a desired ratio of rejuvenating material to milled material is analytically determined.

It is also important to thoroughly intermingle the milled material with the rejuvenating material, which will at least include a fluid but may also include additional sand and/or aggregate. In doing so it is important to maintain retention in the mixer while nevertheless maintaining volume throughput at a desired rate.

It is an object of the present invention to provide a method and apparatus for thoroughly blending the milled material with at least the rejuvenating fluid and with any other rejuvenating materials.

SUMMARY OF THE INVENTION

Improvements are provided in an asphalt pavement resurfacing machine having a transport structure, a heater mounted to the transport structure for heating an underlying asphalt pavement surface to form a heated surface, a mill mounted to the transport structure to follow the heater and grind the heated surface to form a milled material and to prepare the underlying surface to a preset depth, a rejuvenating fluid sprayer for introducing a rejuvenating fluid to the milled material and a mixer for blending the milled material with the rejuvenating fluid. According to the improvement, the mill is provided with at least two outlets of predetermined breadth. A respective height monitor is provided at each of the two outlets for determining the height of the milled material being discharged from each of the outlets. Respective forward facing inlets are provided into the mixer for receiving milled material from each outlet as the machine is advanced in a travel direction. A respective rejuvenating fluid sprayer is provided for spraying rejuvenating fluid on the milled material emanating from each outlet. The mixer may be a pug mill having a housing which has a downwardly facing bottom opening. The mixer may further have a plurality of paddles extending radially from a pug mill shaft mounted within the housing, rotatable with the shaft and orientated to blend the rejuvenating fluid with the milled material and to direct a blended material so formed toward at least one discharge outlet facing rearwardly relative to a travel direction of the resurfacing machine.

Windrow guides may be provided between the mill and the mixer to maintain windrow breadth and to guide the windrows into the mixer.

The improved machine may further comprise a control and processing station which receives input from each height monitor and from a resurfacing machine speed monitor to determine a discharge rate of milled material from each outlet and cause each sprayer to dispense rejuvenating fluid on the milled material at a desired rate based on the discharge rate.

A method is provided for asphalt paved road surface rejuvenation utilizing a structure having a heater, a mill and a mixer carried by a transport structure. The method comprises the steps of:

i) passing the heater over the road surface to heat and soften the road surface and form a preheated surface;

ii) passing the mill over the preheated surface and milling the preheated surface to loosen the preheated surface to a desired depth thus forming a milled material;

iii) discharging the milled material from opposite ends of the mill in respective windrows of known breadth;

iv) measuring windrow height and rate of advance of the transport structure;

v) comparing the breadth in step (iii) with the height and rate of advance in step (iv) to determine volume throughput;

vi) adding a rejuvenating fluid to each windrow at a dosage rate based on a desired weight percentage and the volume throughput;

vii) passing the mixer over the windrows and receiving the windrows through respective openings in the mixer;

viii) blending the rejuvenating fluid with the milled material in the mixer to form a blended mixture; and ix) discharging the blended mixture from the mixer.

The mixer may be a pug mill extending transversely across the support structure and having sufficient breadth to capture the windrows simultaneously.

The pug mill may be operated in an inverted arrangement in which an open face thereof is adjacent the surface to utilize the surface as a bottom thereto.

DESCRIPTION OF THE DRAWINGS

Preferred embodiments of the present invention are described below with reference to the accompanying drawings in which.

DESCRIPTION OF PREFERRED EMBODIMENTS

Figure 1:
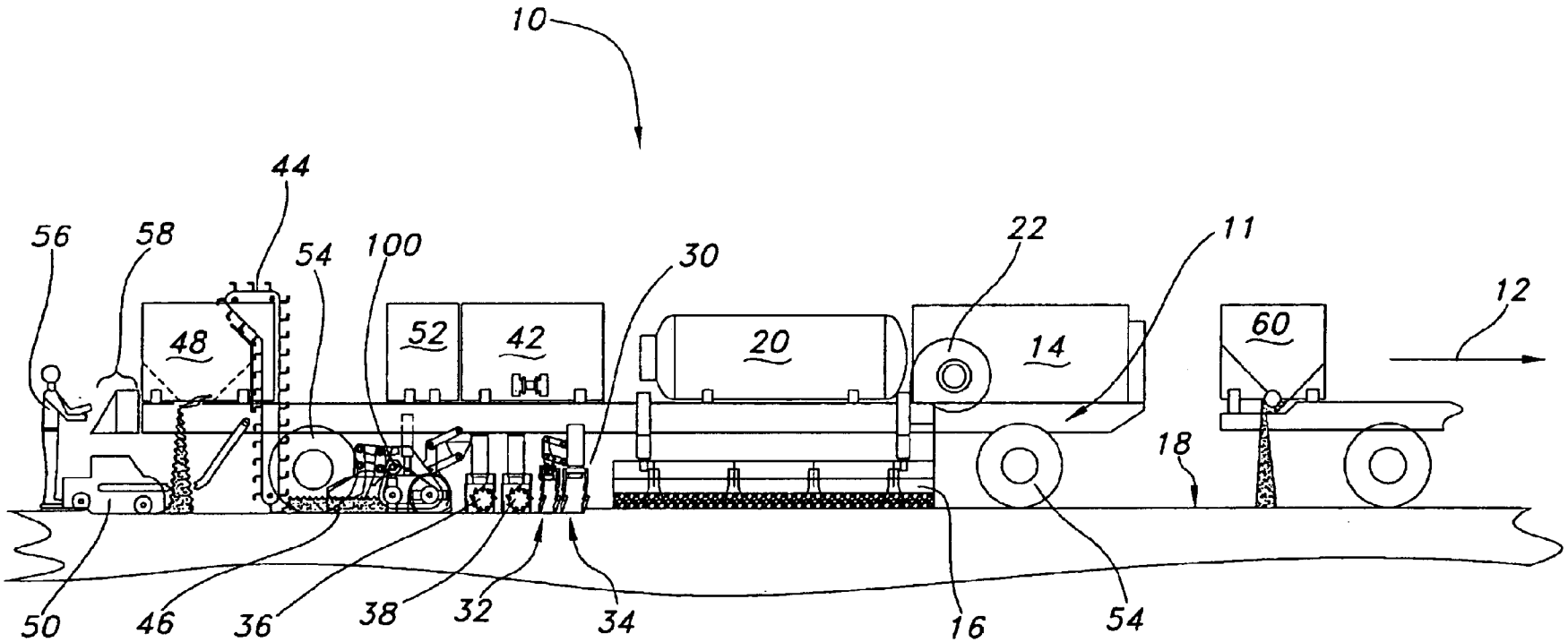
FIG. 1 is a schematic representation of an asphalt resurfacing machine according to the present invention.

An asphalt pavement resurfacing machine is generally indicated by reference 10 in FIG. 1. The resurfacing machine 10 travels in a path of travel indicated by arrow 12. The resurfacing machine 10 has a transport structure 11 to which its various components are mounted. The transport structure 11 is basically a support frame having wheels or tracks 54. A power plant 14 at the front of the transport structure 11 is provided to drive the apparatus and typically includes an engine and a hydraulic system.

Behind the power plant 14 and also mounted on the transport structure 11 is a heater 16 which includes numerous burners and associated plumbing for heating an asphalt paved surface 18 upon which the resurfacing machine 10 travels. A propane (or other combustible fuel) tank 20 and a combustion blower 22 serve the burners in the heater 16. The heater 16 directs heat at the asphalt surface 18 to cause softening of an upper part of the asphalt paved surface 18.

The softened surface 18 may be initially dislodged by a raking device, generally indicated by reference 30, mounted to the transport structure 11, and which follows the heater 16. The raking device 30 has rakes which dislodge the heated surface 18. The raking device 30 may include main rakes 32 and extension rakes 34, the extension rakes 34 performing a similar function to the main rakes 32, but to the outside edges. The main rakes 32 break up material around manholes where a main mill 36 behind the raking device 30 cannot run.

The main mill 36 which is mounted to the transport structure 11 behind the raking device 30 grinds up the material dislodged by the rakes, levels the underlying surface and prepares the surface to a preset depth. Extension mills 38 ahead of the main mill 36 perform a similar function, but process outer material typically from 10 to 15 feet to each side of the resurfacing machine 10 and move it to a central part of the resurfacing machine 10 where it is subsequently processed by the main mill 36.

In some applications the apparatus may be operated without a raking device 30, in which case the softened surface 18 will be directly ground by the main mill 36 and any extension mills 38.

A pug mill 100, also mounted to the transport structure 11, follows the main mill 36 and acts as a mixer for blending the processed material from the main mill 36 with rejuvenating fluid from a tank 42. The pug mill 100 is described in more detail below.

Blended material 46 from the pug mill 100 is picked up by a scalping conveyor 44 which deposits the blended material 46 in a heated holding hopper 48. The holding hopper 48 keeps the blended material 46 hot until it is needed. The holding hopper 48 may be filled through its top with material for start ups or if additional material is needed. The holding hopper 48 may also be dumped if required or at the end of a day's operation.

A screed 50 follows the asphalt rejuvenating apparatus 10 and may be a unit such as typically found on an asphalt paver. The screed 50 lays, spreads and slightly compacts the blended material 46 for final rolling.

A water system 52 may be provided to supply cooling water to the front and rear tires or tracks 54.

An operator 56 operates a control and processing station 58. From initial core samples the amount of rejuvenating fluid, sand and aggregate required to bring the asphalt paved surface 18 up to a suitable specification can be determined. The operator 56 can input and monitor the amounts of rejuvenating fluid, sand and aggregate being added.

A sand/aggregate bin 60 precedes the asphalt pavement resurfacing machine 10. The sand/aggregate bin 60 may be attached to the apparatus 10 or attached to a separate machine (not shown) running in front thereof. Sand/aggregate is metered at a specific rate which is a function of ground speed and specification requirements.

Figure 3:
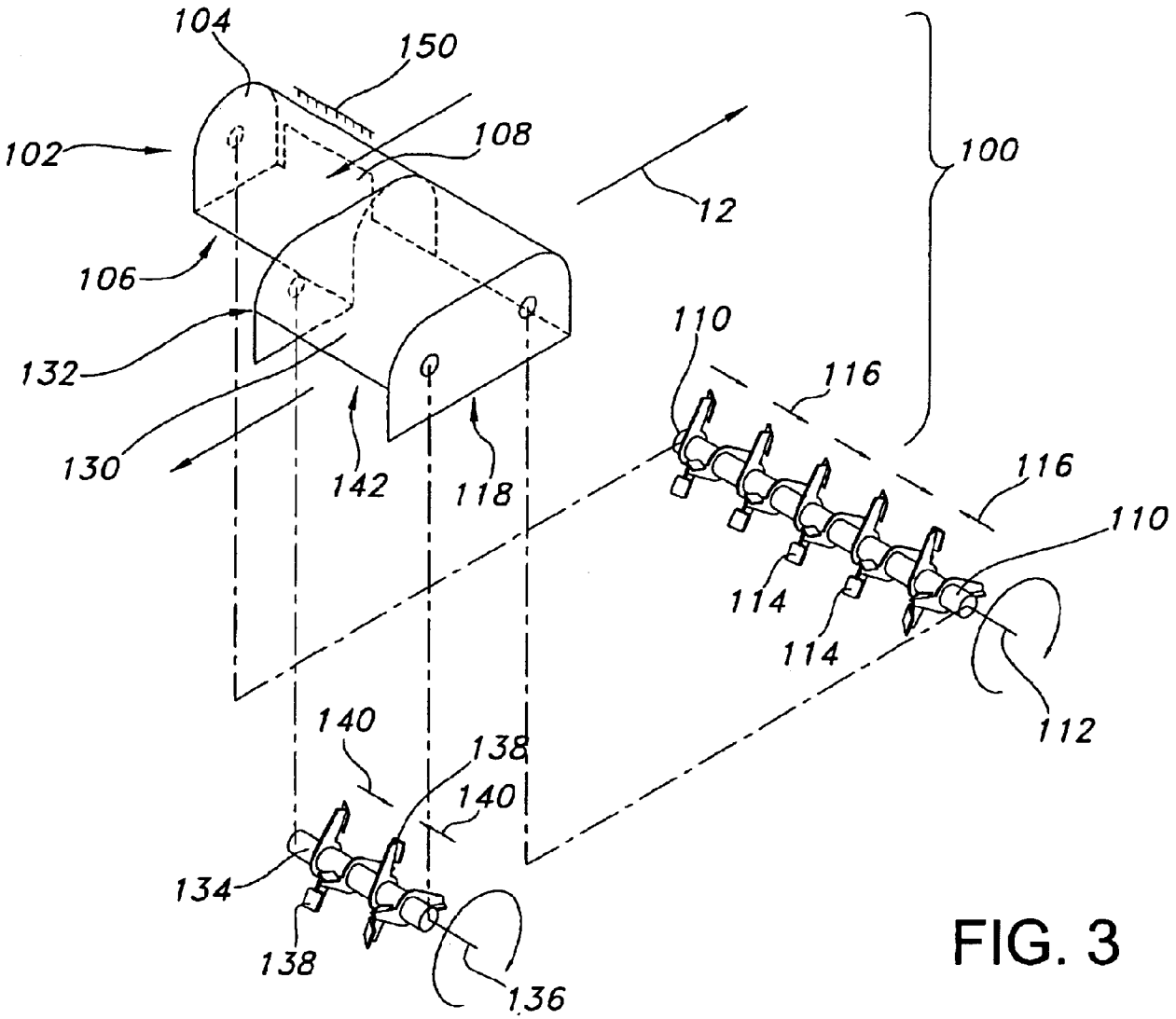

The mixer or "pug mill" 100 is shown in more detail in the exploded view of FIG. 3. The mixer 100 has a first stage 102 which includes a housing or "first stage shell" 104 which is substantially enclosed but for a downwardly facing bottom opening 106. The first stage shell 104 also has an inlet opening 108 through a forward face thereof which faces in the travel direction 12 of the transport structure 11 and a rearwardly facing discharge outlet.

The first stage 102 in use is placed in close proximity to the underlying surface to form a substantially enclosed chamber with the underlying surface acting as a bottom part of the first stage 102. A hydraulic cylinder 120 and parallel bar linkage 122 in FIG. 2 mount the mixer 100 to the transport structure 11 and control the placement of the first stage 102.

A first stage shaft 110 is mounted to the first stage shell 104 for rotation about a first stage shaft axis 112 which extends transversely relative to the travel direction 12. A plurality of paddles 114 extend from the first stage shaft 110 in a direction generally radial relative to the first stage shaft axis 112. The paddles 114 are rotatable with the first stage shaft 110 to blend the milled material with the rejuvenating fluid. The paddles 114 are aligned to direct the blended material (46 in FIGS. 1 and 2) generally in the direction of arrows 116 toward a discharge outlet 118. The discharge outlet 118 faces rearwardly relative to the travel direction 112 and the blended material 46 is discharged therefrom as the resurfacing machine 10 moves in the forward direction 12.

Figure 2:
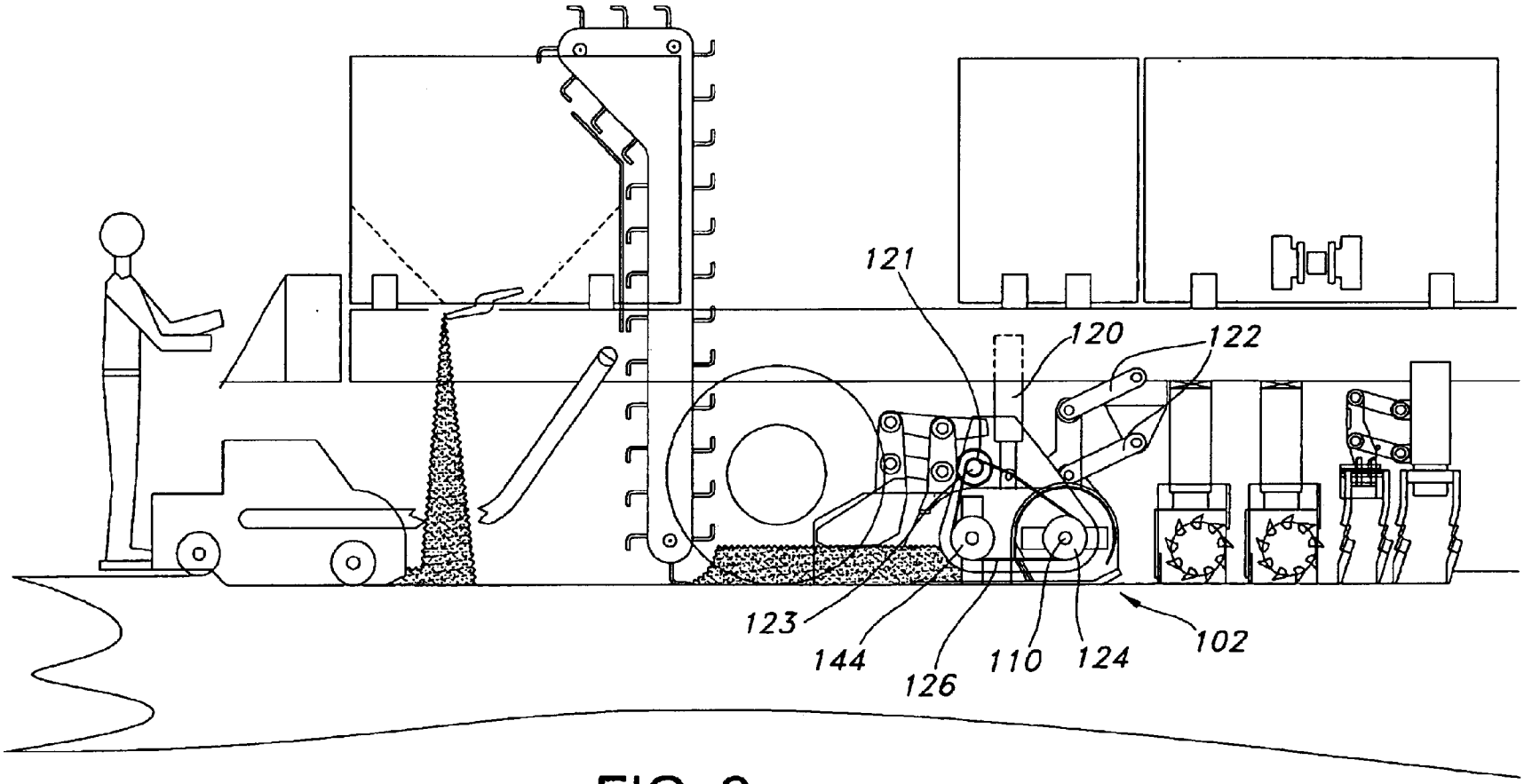
FIG. 2 is an enlarged view of the rearward portion of the asphalt resurfacing machine of FIG. 1; and, FIG. 3 is an exploded view of a mixer according to the present invention.

A rotator for rotating the first stage shaft 110 may take a variety of forms. For example, as illustrated in FIG. 2, a motor 121 may be mounted to the pug mill 102 and rotationally coupled to the first stage shaft 110 by a motor sprocket 123 mounted to the motor 121, a first stage shaft sprocket 124 mounted to the first stage shaft 110 and a roller chain 126 extending therebetween. It will be appreciated by those skilled in driver apparatus for such machinery that the rotator could take a variety of other forms. For example, a direct gear drive may be used instead of the sprocket and chain drive illustrated, or the motor 120 could be directly coupled to the first stage shaft 110.

According to one embodiment, the blended material is not be immediately discharged from the first stage discharge outlet 118, but rather is further blended in a second stage 130 which follows the first stage 102. The second stage receives blended material from the first stage discharge outlet 118. The second stage 130 has a downwardly opening second stage shell 132, which may be integral with and extend from the first stage shell 104. A second stage shaft 134 is mounted in the second stage shell 132 for rotation about a second stage shaft axis 136.

A plurality of paddles 138 extend generally radially from the second stage shaft 134 and are rotatable therewith to further blend the blended material 46. The paddles 138 are oriented to direct the blended material 46 in the direction of arrows 140 toward the second stage discharge opening 142.

The second stage discharge opening 142 faces rearwardly relative to the travel direction 12. The blended material is preferably discharged from the second stage discharge opening 142 in a windrow of fixed breadth determined by the breadth of the second stage discharge opening 142.

A rotator for rotating the second stage shaft 134 may, as illustrated in FIG. 2, be a second stage shaft sprocket 144 mounted to the second stage shaft 110 and about which the roller chain 126 extends.

Rejuvenating fluid may be added at various points in the resurfacing process. Preferably rejuvenating fluid should be added to the milled material prior to its entering the pug mill 100. This may be accomplished by adding rejuvenating fluid at or before the main mill 36 or ahead of the pug mill inlet 108. The latter arrangement is illustrated in FIG. 3 which shows a spray bar 150 for directing rejuvenating fluid at or ahead of the pug mill inlet 108.

Figure 4:
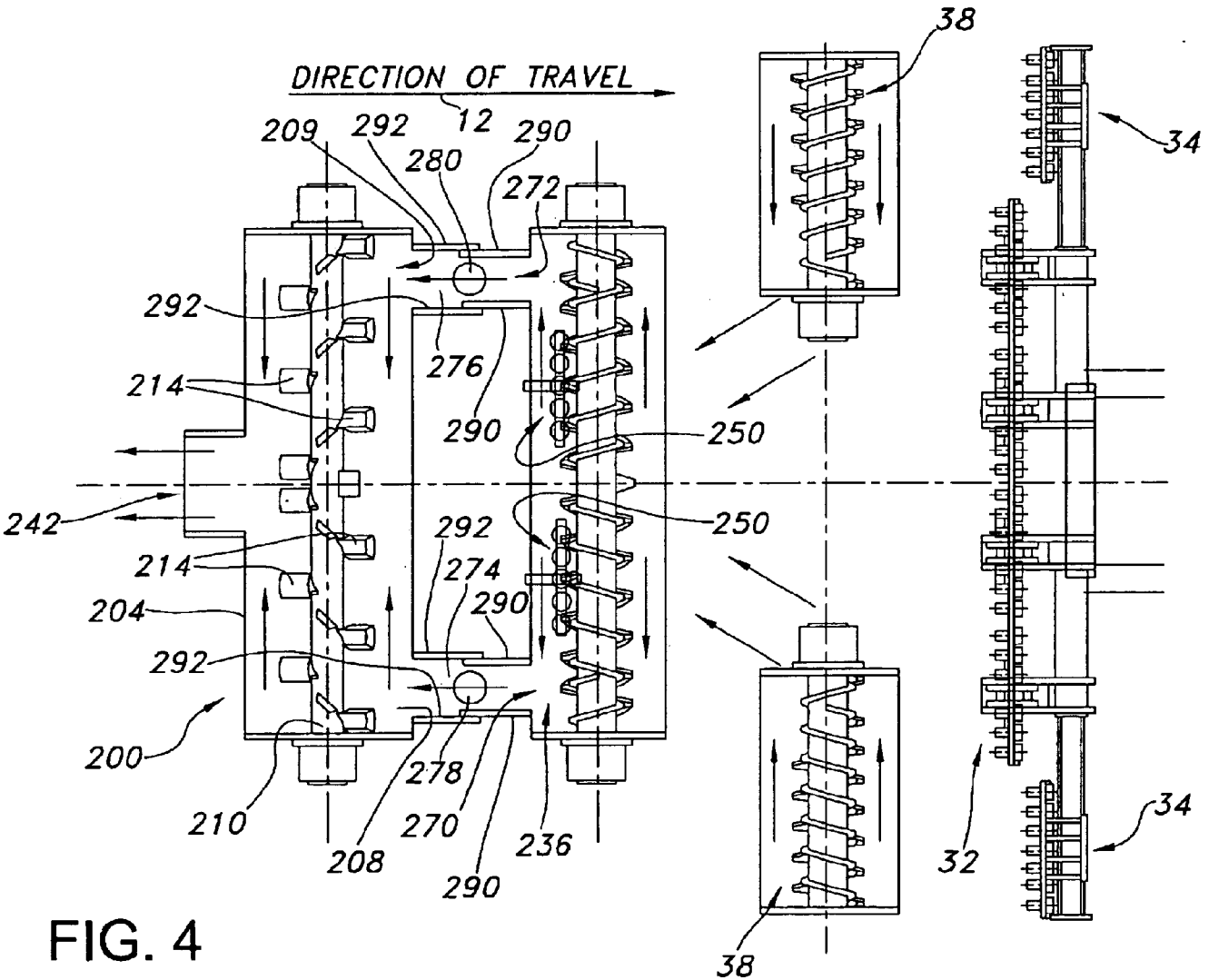
FIG. 4 is a schematic plan view from above of an alternate embodiment arrangement of the milling and mixing stages; and, FIG. 5 is a front elevation corresponding to FIG. 4.
Figure 5:
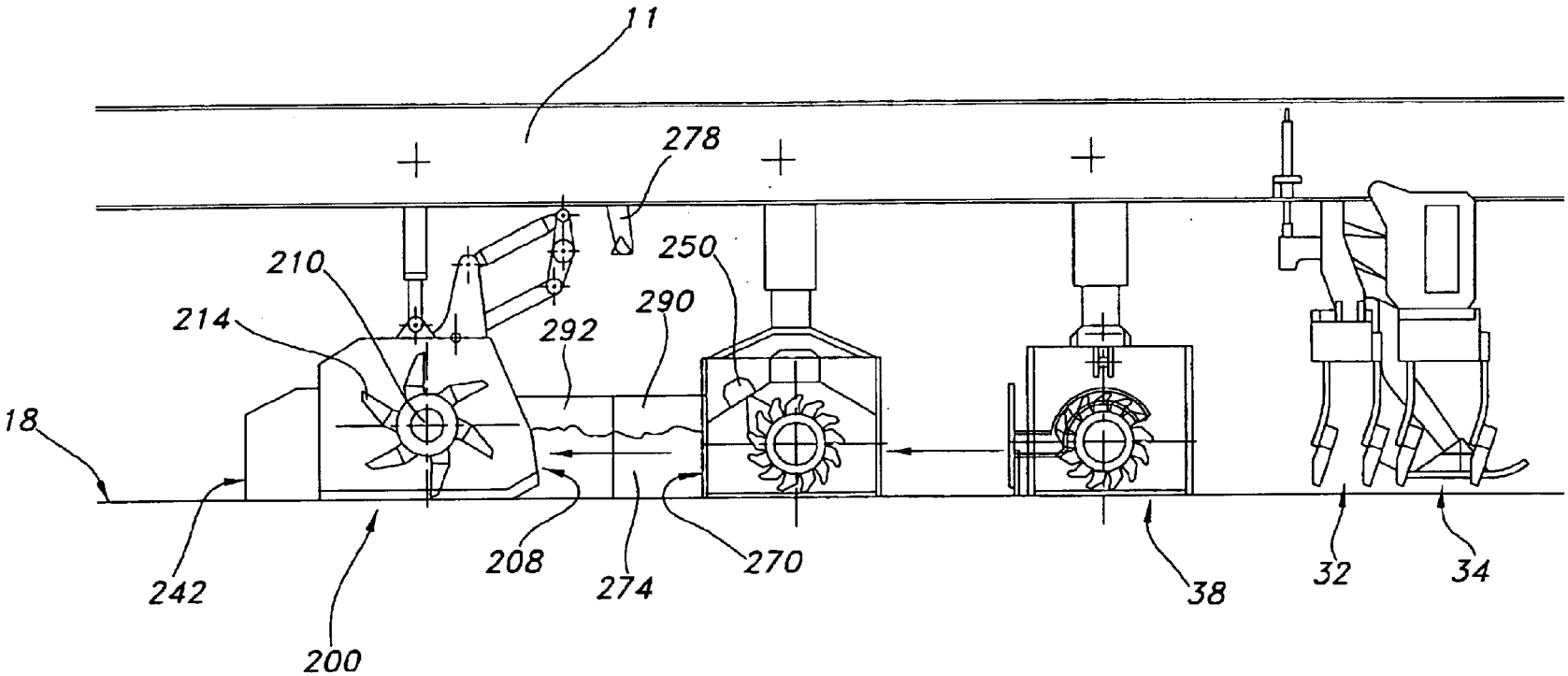

An alternate embodiment of the present invention is illustrated in FIGS. 4 and 5. According to the alternate embodiment, a main mill 236 is configured to discharge milled material through respective outlets 270 and 272 at opposite ends thereof in respective windrows 274 and 276. The outlets 270 and 272 are of known width and a respective ultrasonic scanner or other measuring device 278 and 280 is mounted to a convenient location such as the transport structure 11 or the mill 236 to monitor the height of the windrows 274 and 276. Windrow height data is sent to the control and processing station 58 which also monitors the speed of the resurfacing machine to calculate, preferably for each of the windrows 274 and 276, the volume discharge rate and the requisite addition of rejuvenating fluid.

Test results suggest that the measuring devices 278 and 280 are preferably radar devices such as the SITRANS LR 400 (TM) produced by Siemens Corporation. The SITRANS LR 400 utilizes 24 GHz radar for level measurement of solids or liquids. Radar measuring units appear to be more accurate than ultrasonic scanners and less prone to failure than potentiometer-based devices.

As the main mill 236 in the alternate embodiment has two outlets 270 and 272, a correspondingly designed pug mill 200 is required. The pug mill 200 is a single stage design having a single long pug mill shaft 210 mounted within a pug mill shell or, housing 204. The pug mill housing has respective inlet openings 208 and 209 at opposite ends thereof aligned with the outlets 270 and 272 of the main mill 236. The inlet openings 208 and 209 receive the windrows 274 and 276 respectively.

In order to maintain the breadth of the windrows 278 and 280, windrow guides 290 may be provided which extend from opposite sides of the outlets 270 and 272 of the main mill 236. Corresponding guides 292 may be provided which extend from the inlet openings 208 and 209 of the pug mill 200. Preferably one of the windrow guides 290 and 292 will be metal, and the other an elastarmeric material such as rubber to maintain a reasonably good seal therebetween. The windrow guides 290 and 292 assist both in maintaining a constant windrow breadth and in ensuring that the entire windrow is directed into the pug mill 200. Maintaining the breadth enhances the accuracy of the volume throughput measurement based on the height measurement.

Paddles 214 extend radially from the pug mill shaft 210 to blend the milled material with rejuvenating fluid. Preferably the rejuvenating fluid is sprayed on the windrows 274 and 276 in metered amounts by the sprayers 250 as calculated by the control and processing station 58. The blended material is directed by the paddles 214 for discharge through a rearwardly facing discharge opening 242.

An advantage of adding rejuvenating fluid after milling is that the dislodged road surface has a further opportunity to cool which has the benefit of reducing the amount of smoke generated by the resurfacing machine 10. Additionally, providing two windrows of material from the main mill 236 can significantly increase production rate by a factor of about two (2).

A further advantage of the alternate embodiment of FIGS. 4 and 5 is enhanced response time (or reduced lag). Monitoring throughput of milled material at about the same point as the addition of rejuvenating fluid permits quick response and a high level of accuracy. In the first embodiment described above, a delay or lag of at least four (4) to five (5) feet would occur between the monitoring of volume throughput and the addition of rejuvenating fluid. While this is still a vast improvement over earlier systems, it does generate some error in uneven surfaces when fluctuations in the pug mill output may not coincide with fluctuations in the amount of surface being milled.

As in the first embodiment described above having a two stage pug mill 100, the shell 204 of the long single stage pug mill 200 is substantially enclosed but for a downwardly facing bottom opening 206, the inlet openings 208 and 209 and the discharge opening 242. The bottom opening 206 in use would be held in close proximity to the underlying surface for the underlying surface 18 to act as a bottom of the pug mill 200.

The above description is intended in an illustrative rather than a restrictive sense. Variations to the specific embodiments described may be apparent to those skilled in such apparatus and processes without departing from the spirit and scope of the invention as defined by the claims set out below.

I claim:

1. In an asphalt pavement resurfacing machine having a transport structure, a heater mounted to said transport structure for heating an underlying asphalt pavement surface to form a heated surface, a mill mounted to said transport structure follow said heater and grind said heated surface to form a milled material and to prepare said underlying surface to a preset depth, a rejuvenating fluid sprayer for introducing a rejuvenating fluid to said milled material and a mixer for blending said milled material with said rejuvenating fluid, the improvement comprising:

providing said mill with at least two outlets of predetermined breadth;

providing a respective height monitor at each of said two outlets for determining the height of milled material being discharged from each outlet;

providing respective forward facing inlets into said mixer for receiving milled material from each said outlet as said machine is advanced in said travel direction;

providing a respective rejuvenating fluid sprayer for spraying rejuvenating fluid on said milled material adjacent each said outlet;

said mixer being a pug mill having a housing with a downwardly facing bottom opening; and, said mixer having a plurality of paddles extending radially from a pug mill shaft housed within said housing, rotatable with said shaft and oriented to blend said rejuvenating fluid with said milled material and to direct a blended material thus formed toward at least one discharge outlet facing rearwardly relative to a travel direction of said resurfacing machine.

2. An asphalt pavement resurfacing machine as claimed in claim 1 further comprising:

a control and processing station which receives input from each said height monitor and from a resurfacing machine speed monitor to determine discharge rate of milled material from each said outlet and cause each said sprayer to dispense rejuvenating fluid on said milled material at a desired rate based on said discharge rate.

3. An asphalt pavement resurfacing machine as claimed in claim 2 wherein:

windrow guides extend between said outlets of said mill and said inlets of said mixer to maintain windrow breadth and guide the windrows into said inlets.

4. A method of asphalt paved road surface rejuvenation utilizing a structure having a heater, a mill and a mixer carried by a transport structure, said method comprising the steps of:

i) passing said heater over said road surface to heat and soften said road surface and form a preheated surface;

ii) passing said mill over said preheated surface and milling said preheated surface to loosen said preheated surface to loosen said preheated surface to a desired depth thus forming milled material;

iii) discharging said milled material from opposite ends of said mill in respective windrows of predetermined breadth;

iv) measuring windrow height and rate of advance of said transport structure;

v) comparing said breadth in step (iii) with said height and rate of advance in step (iv) to determine volume throughput;

vi) adding a rejuvenating fluid to said windrows at a dosage rate based on a desired weight percentage and said volume throughput;

vii) passing said mixer over said windrows and receiving said windrows through respective openings in said mixer;

viii) blending said rejuvenating fluid with said milled material in said mixer to form a blended mixture; and, ix) discharging said blended mixture from said mixer.

5. The method of claim 4 wherein:

said mixer is a pug mill extending transversely across said support structure and having sufficient breath to capture said windrows simultaneously.

6. The method of claim 5 wherein:

said pug mill is operated in an inverted arrangement in which an open face thereof is adjacent said surface to utilize said surface as a bottom thereto.

* * * * *